US007551936B2

(12) United States Patent
Schropp et al.

(10) Patent No.: US 7,551,936 B2
(45) Date of Patent: Jun. 23, 2009

(54) METHOD OF RADIO TRANSMISSION IN A DANGER ALARM SYSTEM

(75) Inventors: Werner Schropp, Munich (DE); Karlheinz Schreyer, Wolfratshausen (DE)

(73) Assignee: Siemens Gebaudesicherheit GmbH & Co. OHG, Munich (DE)

( * ) Notice: Subject to any disclaimer, the term of this patent is extended or adjusted under 35 U.S.C. 154(b) by 632 days.

(21) Appl. No.: 10/233,215

(22) Filed: Sep. 3, 2002

(65) Prior Publication Data

US 2004/0203343 A1 Oct. 14, 2004

(51) Int. Cl.
*H04B 7/10* (2006.01)

(52) U.S. Cl. ..... 455/507; 340/506

(58) Field of Classification Search ..... 455/11.1, 455/494.1, 521, 507, 573, 574, 7; 340/545.1, 340/506, 571; 370/349
See application file for complete search history.

(56) References Cited

U.S. PATENT DOCUMENTS

| | | | | |
|---|---|---|---|---|
| 5,402,101 | A * | 3/1995 | Berger et al. | 340/286.02 |
| 5,977,871 | A * | 11/1999 | Miller et al. | 340/506 |
| 6,058,137 | A * | 5/2000 | Partyka | 375/201 |
| 6,393,308 | B1 * | 5/2002 | Isomichi et al. | 455/701 |
| 6,624,750 | B1 * | 9/2003 | Marman et al. | 340/506 |
| 2002/0047774 | A1 * | 4/2002 | Christensen et al. | 340/3.54 |
| 2002/0196748 | A1 | 12/2002 | De Mier | |
| 2003/0105856 | A1 * | 6/2003 | Tse et al. | 709/204 |

FOREIGN PATENT DOCUMENTS

| | | |
|---|---|---|
| DE | 19754864 | 9/1998 |
| DE | 19741085 | 4/1999 |
| EP | 0911775 | 4/1999 |
| EP | 1028403 | 8/2000 |
| WO | WO 99/17477 | 4/1999 |
| WO | WO 00/52658 | 9/2000 |
| WO | 0143350 | 12/2000 |

OTHER PUBLICATIONS

Royer E M et al: A Review of Current Routing Protocols for Ad Hoc Mobile Wireless Networks2 IEEE Personal Communications; IEEE Communications Society; us; Bd: 6 Nr. 2, Apr. 1999, Seiten 46-55, XPOOO823968, ISSN: 1070-9916.

* cited by examiner

*Primary Examiner*—Edward Urban
*Assistant Examiner*—Tu X Nguyen
(74) *Attorney, Agent, or Firm*—King & Spalding L.L.P.

(57) ABSTRACT

A method for radiotransmission in a danger alarm system that operates by way of repeaters but has a current-saving design, so that battery operation is possible. The reception means are switched on cyclically at preassigned points in time, and transmission-ready participants send a preamble leading to the result that the intended recipient participants, in event of reception, remain switched on until the end of the complete preamble, and in the event that no preamble is received, are switched on again. In the preamble, a point in time is transmitted at which the receiver switches on again, to receive the data telegram proper.

11 Claims, 2 Drawing Sheets

| 1 | 2 | 3 | 4 | 5 | 6 | 7 | 8 | 9 | 10 | ... | n-2 | n-1 | N |
|---|---|---|---|---|---|---|---|---|---|---|---|---|---|
| 5 | 5 | 5 | 5 | 5 | 6 | X | 8 | 6 | 6 | ... | R | S | T |

| 1 | 2 | 3 | 4 | 5 | 6 | 7 | 8 | 9 | 10 | ... | n-2 | n-1 | N |
|---|---|---|---|---|---|---|---|---|---|---|---|---|---|
| 1 | 12 | 3 | 4 | X | 6 | 7 | 7 | 6 | 6 | ... | J | K | L |

| 1 | 2 | 3 | 4 |
|---|---|---|---|
| X | 2 | - | - |

| 1 | 2 | 3 | 4 |
|---|---|---|---|
| 1 | X | - | - |

| 1 | 2 | 3 | 4 |
|---|---|---|---|
| X | 2 | 2 | - |

FIG 4a

| 1 | 2 | 3 | 4 |
|---|---|---|---|
| 1 | x | 3 | - |

FIG 4b

| 1 | 2 | 3 | 4 |
|---|---|---|---|
| 2 | 2 | x | - |

FIG 4c

| 1 | 2 | 3 | 4 | 5 | 6 | 7 | 8 | 9 | 10 | 11 |
|---|---|---|---|---|---|---|---|---|---|---|
| 1 | 12 | 3 | 4 | X | 6 | 7 | 7 | 6 | 6 | 4 |
| | | | B | B | B | B | C | C | C | C |
| A | A | A | A | | | A | | | | |

FIG 5

| 1 | 2 | 3 | 4 | 5 | 6 | 7 | 8 | 9 | 10 | ... | n-2 | n-1 | n |
|---|---|---|---|---|---|---|---|---|---|---|---|---|---|
| 1 | 12 | 3 | 4 | X | 6 | 7 | 7 | 6 | 6 | ... | j | k | l |
| 17 | 25 | 19 | 5 | | 3 | 12 | 12 | 3 | 3 | | | | 3 |

FIG 6

METHOD OF RADIO TRANSMISSION IN A DANGER ALARM SYSTEM

BACKGROUND OF THE INVENTION

The invention relates to a method of radiotransmission in a danger alarm system.

Radio is an ideal transmission medium for use in buildings. Equipment using radiotechnology can be quickly installed and easily adapted to necessary requirements. One disadvantage, however, is the relatively short range of radio at carrier frequencies in the gigahertz band. When so-called "repeaters" are employed to enhance the range, the high energy consumption requires network-supplied equipment. This applies especially to radio equipment in the new "SRD" band between 868 and 870 Mhz. In equipment using repeaters for range enhancement, information must reach its destination in a short time by way of a number of stations. For purposes of building safety (fire alarm, intrusion protection) this time amounts to several seconds, and in building automation (lighting equipment) the time is less than one second. To ensure this, powerful computers are required to find the correct route through a widely ramified network in which probabilities are examined, paths are pre-selected, statistics are set up, etc. This requires storage space, computer performance, and last but not least, an amount of electrical energy for which not even a year's supply by batteries is suitable at the present time.

EP 0,911,775 discloses a method of radiotransmission in a danger alarm system, suitable for battery operation. Here, in response to routine signals from peripheral elements, the center issues a receipt signal, which is used by transmission-ready peripheral elements as starting signal for transmission of alarm data to the center. In the case of several available radio channels, routine signals are issued and receipt signals awaited in successive channel time slots until a receipt signal is received in a time slot of the connection. This receipt signal is received by a transmission-ready peripheral element which, on the same radio channel identified as free, then sends its alarm data to the center in the next time slot for alarm data transmission. This method is distinguished by minimal energy consumption in combination with short monitoring and reaction times in the range of seconds. One disadvantage is the comparatively costly procedure and the long reaction times in repeater operation. Since the participants of the system must keep themselves synchronous, they must synchronize their internal clocks. This results in relatively heavy radio traffic and consequently the need for several radio channels.

DE 19905 316 discloses a data transmission system, in particular for consumption data detection, comprising at least one transmitter and one receiver for receiving data packages transmitted at time intervals from a respective transmitter. Here, the receiver includes a time control means for temporal control of its reception operation, estimating the point in time of the next data transmission currently awaited on the basis of target values for the time intervals of successive data packages, and in each instance switching the receiver reception-ready temporarily during a tolerance interval containing the estimated point in time. The length of the data package is here limited to the tolerance interval.

SUMMARY OF THE INVENTION

It is the object of the present invention to provide a method of radio-transmission in a danger alarm system, suitable for a repeater operation, which affords short reaction times, current saving operation, and permitting flexible data telegram lengths. This object is accomplished by having the reception means of the participants cyclically switched on at preassigned times, and transmission-ready participants sending preambles containing the address of the participant who is to receive the preamble. Where a reception means receives one of the preambles addressed to this reception means, then the reception means remains switched on until the complete preamble has been received; and in the event that no preamble addressed to this reception means has been received, the reception means is switched off again. In accordance with the invention, it is also provided that in the preamble, only the start time of the data telegram is transmitted, and the reception means switches on at this start time, with the transmission-ready participant sending out the corresponding data telegram at that start time. This method ensures that the receiver remains ready to operate for some years on one battery, for example an inexpensive AA cell.

In a preferred embodiment of the novel method, the reception means, while in switched-on condition, changes the reception frequency to comply with the FCC regulations for "frequency hopping" in effect in the USA at the time. The cycles are so chosen that the time interval in which the reception means is switched off is greater by more than a factor of 5 than the time interval in which the reception means is switched on. Thereby sending out the corresponding data telegram at that start time. Radio traffic can be further reduced in that the transmission-ready participant, in event of a desired transmission to several intended recipient participants, sends out a preamble only once, and the corresponding reception means remain switched on until the preamble has been received.

In order to build up as large a danger alarm network as possible, the invention further provides that telegrams are transmitted from transmission-ready participants to intended recipient participants by way of so-called intermediating participants. In a storage means of the participants, a list is stored in which the addresses of the intermediating participants are stored.

A further preferred embodiment of the present invention provides for jointly reaching several participants, through the use of a list which can also include group memberships. In methods in which the frequency is changed, a preferred embodiment entails the capability of having it indicated in the list on which frequency channel the intended recipient participant can be reached. Where the method entails frequency change, it may be simplified by effecting a change of frequency according to a formula known to all participants.

In event of interference with transmission between two participants, it is further provided that the intended recipient participant may be reached also by way of other—in that case intermediating—participants. And yet another advantageous provision is provided so that a designated participant optimizes the lists of the other participants and sends these optimized lists to the other participants.

An especially preferred method of configuration of the present invention enables the participants to be brought at the outset of the operation into a configuration mode in which the participants search for the other participants, and include them in their lists when found. In this way, configuration outlay can be minimized.

BRIEF DESCRIPTION OF THE DRAWINGS

The invention is disclosed in more detail with reference to the drawings, in which:

FIGS. 4*a,* 4*b* and 4*c* illustrate the lists of three participants in configuration mode;

FIG. 5 illustrates the list of a participant, in which additionally the group membership of the several participants is entered; and FIG. 6 illustrates the list of a participant with frequency channels provided for transmission.

DETAILED DESCRIPTION OF THE INVENTION

Figures 1, 2A, 2B, 3A, 3B:
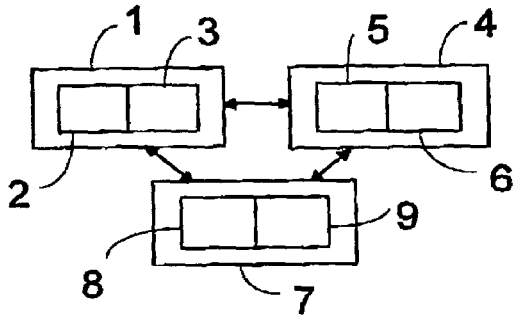
FIG. 1 illustrates a schematic view of a danger alarm system having three participants.
FIGS. 2*a* and 2*b* illustrate examples of lists such as are stored in the storage means.
FIGS. 3*a* and 3*b* illustrate the lists of two participants in configuration mode.

In FIG. 1, it is shown how a first participant 1 is equipped with a first transmitter 2 and a first receiver 3, said first participant 1 forming a danger alarm system with a second participant 4 (likewise having a second transmitter 5 and a second receiver 6), and with a third participant 7 (having a third transmitter 8 and a third receiver 9). The individual participants 1, 4, 7 may here for example have additional sensors, detecting for example a fire hazard or, by motion alarm, an attempted intrusion. Participants 1, 4, 7 may moreover assume central functions, for example initiating an alarm or indicate a view of the building with corresponding alarm locations. Conceivably also, the individual participants 1, 4, 7 may have servo drives to close doors, switch on lights, or set blinds in motion.

The requisite HF receivers in the 1 Ghz band typically consume 10 to 30 mA at 3 V. The service life of a battery should be about four years. For inexpensive AA cells ("Mignon"), such a current is 300 to 1000 times as great.

According to the present invention, the receiver regularly (for example every 300 ms) checks whether a transmission-ready participant is active. The transient time of the receiver must here be so small that the resulting mean current will not unduly tax the batteries. Transient times of less than 1 ms, are today technically feasible.

A transmission-ready participant sends a preamble enabling the receiver to recognize the inquiry. In the present example, this preamble must be transmitted for 300 ms in order to ensure that the intended recipient participant will have his receiver switched on at that time. Additional information in the preamble refers to the start time of the telegram proper. The recipient is then switched-off again until the beginning of the message information, thus saving current.

To comply with the FCC regulations in force in the USA for frequency change, the frequency of the reception channel is changed in the time during which the receiver is switched on.

In the event that a transmission-ready station is to make contact with several other participants, the preamble is sent out only once, and the corresponding receivers for the intended recipient participants do not switch off immediately but await the exchange of telegrams.

For organization of the network, provision is made so that, in a radio cell of, for example, n participants, each participant keeps a list giving information concerning by way of which next participant (intermediator) it can reach an arbitrary other participant of the radio cell. Such a list is illustrated for example in FIG. 2*a.* In this list for participant 7, the participant to be reached is entered in the first line, and the first intermediator provided therefor in the second line. The participant 7 represented in FIG. 2*a* reaches participants 5, 6 and 8 directly, while participants 1 to 4 are to be reached by way of 5, and participants 9 and 10 by way of participant 6. That participant 2 may be reached by way of participant 5 does not imply that participant 5 has direct contact with participant 2. An additional intermediator may indeed be provided, as represented in the exemplifying list of participant 5 in FIG. 2*b.*

According to the invention, provision is made so that the first-time acquisition of the list takes place without an additional "tool." "For this purpose, the following steps are taken: the first participant of the radio cell is brought into a configuration mode. The participant searches for participants in configuration mode already present. Since the first participant finds no other such participant, this participant himself defines a cell number and waits for other participants to report to him. The second participant in the radio cell is brought into configuration mode. He finds participant 1, and proceeds so that he himself is number 2. Both have now each occupied a place in their list, as represented in FIG. 3*a* for participant 1 and in FIG. 3*b* for participant 2. Then the third participant is brought into configuration mode. Now if he, for example, finds only participant 2, and not participant 1, he has his list transmitted to himself. Thus, the third participant knows that he can reach participant 1 by way of participant 2 and is integrated in the system as participant 3. Participant 2 now transmits to participant 1 that participant 3 can reach (participant 2) by way of him. The corresponding stored lists then correspond to FIG. 4*a* for participant 1, to FIG. 4*b* for participant 2, and to FIG. 4*c* for participant 3.

In event of loss of the connection between two participants n and m, n attempts to set up the connection again by way of another participant. For this purpose, this participant applies to the participants whom he can reach directly and checks whether they have contact with n. If so, participant n will correct his list accordingly. The same applies to participant m.

In FIG. 5, it is shown that each participant of a radio cell may be assigned to one or more functional groups. These functional groups are imaged in other lines of the lists, as indicated by letters A, B and C in FIG. 5. Here, each participant, as shown, may belong to several groups simultaneously, as in the example of participant 6, who belongs to groups A and B simultaneously. By means of such groups, for example collectives of lamps may be switched jointly.

If a "broadcast" message is to be sent to such a group, and if a participant receives such a telegram and belongs to the indicated collective, he executes the command, even if not addressed to him directly. In that case, no receipt is issued. In this way, the reaction time of a group can be drastically reduced. A following, directly, addressed command with the same content remains without effect, but is receipted. To optimize the lists, provision is made so that a designated participant of the cell has the right to optimize the list of the other participants. For that purpose, the said designated participant collects the lists of all participants and optimizes them with reference, for example, to additional attributes of the connections, such as field strength or error frequency. After the designated participant has optimized the network of connections of the cell, he sends the list back to the individual participants again.

For systems with frequency change, additional provision is made so that it is indicated in the lists by way of which frequency channel the particular participant may be reached in the next cycle. Such an example is represented in FIG. 6. The list represented in FIG. 6 applies to participant 5. If this participant is to send a telegram to participant 8, he applies to participant 7, using frequency channel No. 12 for the purpose. Since the channel numbers must be regularly changed, this must occur within the scope of normal telegrams. Here, the future channel number of old telegrams is included.

If the channel change is carried out according to a formula known to all participants, then even in the case where a telegram is lost, the corresponding party can phase himself in by attempting to restore contact through the succeeding channels according to the formula.

In this way, a current-saving spontaneously reacting radio system is set up, making possible battery-supplied repeaters. The microcontrollers employed, however, here require only a small working memory. Despite the possibility of "autorouting," one word per participant suffices.

The invention claimed is:

1. A method of radiotransmission of a message consisting of a preamble and a data telegram to a plurality of receivers in a danger alarm system having a plurality of participants each having a transmitter and a receiver, wherein each receiver has a predefined address, comprising the steps of:

cyclically switching-on the receivers at preassigned time intervals, sending the preamble including a plurality of addresses for said plurality of receivers by a transmission-ready participant for at least the duration of an interval, wherein only receivers to which one of said plurality of address is assigned in the event of receiving the preamble, remaining switched-on until the preamble is completed, and in the event that no address is received, being switched-off, wherein the start time of the data telegram is transmitted in the preamble, the plurality of receivers, after receiving the start time, are switched-off, and switched-on again at that start time, and the transmission-ready participant sends out a telegram over his transmitter at the start time which is received by the plurality of receivers.

2. The method of radiotransmission according to claim 1, wherein the receiver participants change a frequency channel.

3. The method of radiotransmission according to claim 1, wherein a time interval in which the receivers are switched-off is greater by more than a factor of 5 than a time interval in which the receivers are switched-on.

4. The method of radiotransmission according to claim 2, wherein a frequency channel corresponding to a participant to be reached is stored in a list stored in a storage means.

5. The method of radiotransmission according to claim 4, wherein a change of frequency channels occurs according to a formula known to all participants.

6. The method of radiotransmission according to claim 1, wherein upon losing a connection between at least two participants, the transmission-ready participant queries all participants reachable directly without aid of intermediating participants as to whether a lost recipient participant can be reached by way of them.

7. The method of radiotransmission according to claim 1, wherein a telegram from a transmission-ready participant is transmitted to an intended recipient participant by way of one or more intermediating participants, and further wherein the participant has a storage means containing a list in which the addresses of intermediating participants by which an intended recipient participant is reached.

8. The method of radiotransmission according to claim 7, wherein several participants are assembled in a group, and a group membership is contained in the list.

9. The method of radiotransmission according to claim 8, wherein certain telegrams are sent to a group, the content of which is followed by all participants who belong to the group.

10. The method of radiotransmission according to claim 7, wherein a stored list is transmitted to a designated participant who optimizes the list and sends it to other participants who store it in their storage means in place of an original list.

11. The method of radiotransmission according to claim 7, wherein the participants comprise a configuration mode in which the participants search for other participants in configuration mode, and upon finding other participants, include them in their list, and further wherein information about said participants who have not been found directly in configuration mode is transmitted to these participants by way of an intermediating participants who thereafter complete their lists.

* * * * *